US005437168A

United States Patent [19]

Mason et al.

[11] Patent Number: 5,437,168

[45] Date of Patent: Aug. 1, 1995

[54] TOP LOADING HORIZONTAL AXIS AUTOMATIC WASHER

[75] Inventors: Anthony Mason, Lincoln Township, Berrien County; Brenner M. Sharp, St. Joseph; Victor W. Cuthbert, Sodus Township, Berrien County, all of Mich.

[73] Assignee: Whirlpool Corporation, Benton Harbor, Mich.

[21] Appl. No.: 235,999

[22] Filed: May 2, 1994

[51] Int. Cl.[6] ..... D06F 37/26

[52] U.S. Cl. ..... 68/3.00 R; 68/142; 68/210; 68/24

[58] Field of Search ..... 68/3 R, 142, 144, 139, 68/210, 58, 24, 140

[56] References Cited

U.S. PATENT DOCUMENTS

| | | | |
|---|---|---|---|
| 130,835 | 12/1941 | Altorfer . | |
| 1,149,814 | 8/1915 | Eden | 68/140 |
| 1,508,400 | 9/1924 | Kronmiller | 68/143 |
| 1,913,764 | 6/1933 | Lindberg | 68/142 |
| 2,734,368 | 2/1956 | Richardson | 68/142 |
| 2,873,599 | 2/1959 | Buechler | 68/140 X |
| 2,895,320 | 7/1959 | Long | 68/58 |
| 3,240,038 | 3/1966 | Schwegler | 68/24 |
| 3,531,954 | 10/1970 | Krupsky | 68/18 |
| 3,908,412 | 9/1975 | de Hedouville | 68/24 |
| 3,945,226 | 3/1976 | de Hedouville | 68/23 |
| 4,862,712 | 9/1989 | Huttemann | 68/17 |
| 4,936,117 | 6/1990 | Kabeya | 68/3 R |
| 5,029,458 | 7/1991 | Obata et al. | 68/19.2 |

FOREIGN PATENT DOCUMENTS

| | | | |
|---|---|---|---|
| 151923 | 6/1953 | Australia | 68/142 |
| 095661 | 7/1983 | European Pat. Off. | D06F 37/10 |
| 116878 | 2/1984 | European Pat. Off. | D06F 37/10 |
| 120388 | 3/1984 | European Pat. Off. | D06F 37/10 |
| 133302 | 2/1985 | European Pat. Off. | D06F 37/10 |
| 347393 | 12/1985 | European Pat. Off. | D06F 37/10 |
| 0406115 | 6/1990 | European Pat. Off. | D06F 39/14 |
| 1273418 | 9/1961 | France | 68/142 |
| 2570396 | 9/1985 | France | D06F 37/00 |
| 245451 | 5/1981 | Germany | 68/142 |
| 59-194794 | 11/1984 | Japan | 68/140 |

*Primary Examiner*—Frankie L. Stinson

*Attorney, Agent, or Firm*—Thomas A. Schwyn; Joel M. Van Winkle

[57] ABSTRACT

A top-loading horizontal axis automatic washer with improved accessibility to the wash basket interior and improved operating convenience of the basket doors. The washer cabinet is provided with an access opening extending partially along the front surface and top surface of the washer cabinet, providing the operator with improved access to the basket interior through an aligned tub opening and basket opening. A lid is provided on the cabinet top for selectively opening and closing the access opening. First and second door flaps are provided on the back and front edges, respectively, of the basket opening, serving as doors for selectively opening or closing the basket opening. The second door flap has an arc length approximately one-third the size of the first door flap. Both flaps are arranged so that, when opened, they are out of the path of loading and unloading clothes items from the basket. The door flaps are further arranged for simultaneous single-handed closing, whereby when the first door flap is moved from an open position to a closed position it overlaps the leading edge of the open second door flap, causing the second door flap to simultaneously move to a closed position.

15 Claims, 12 Drawing Sheets

18
32
12e
64
10
30
14
55a
22
16
34
12
12a
12c

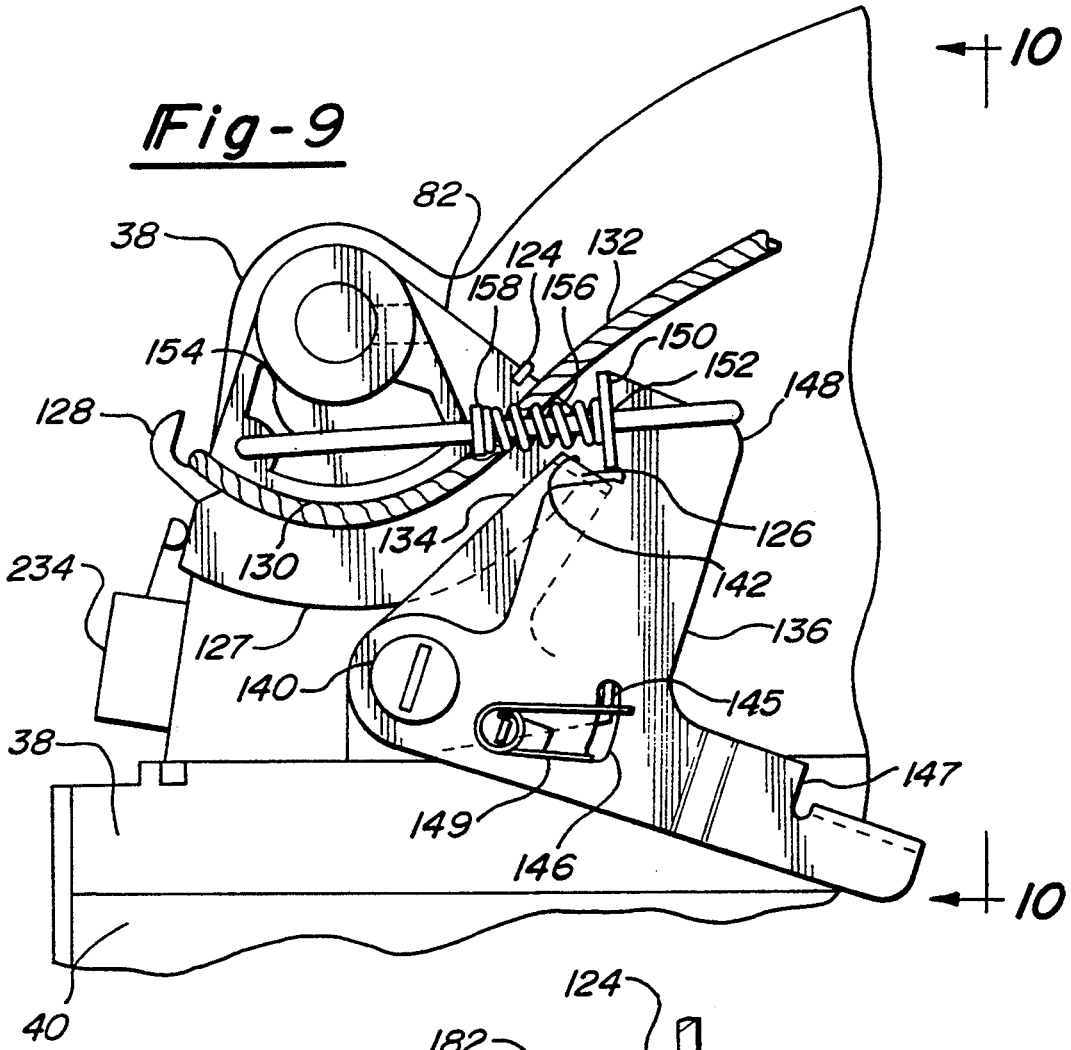
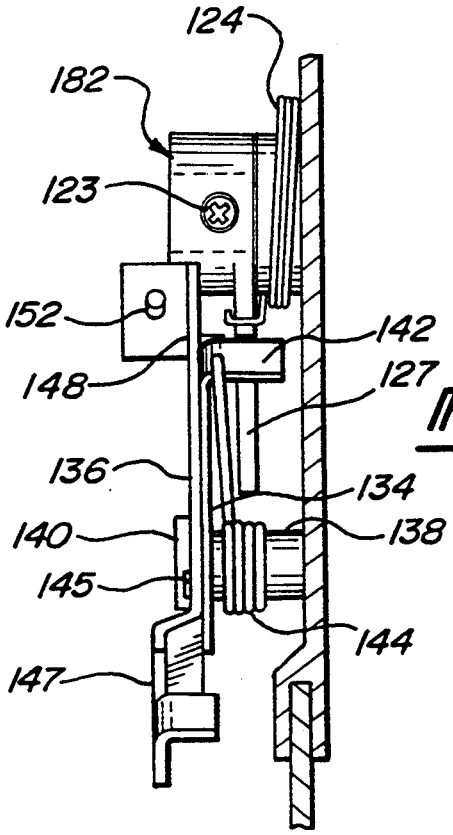
Fig-10

TOP LOADING HORIZONTAL AXIS AUTOMATIC WASHER

BACKGROUND OF THE INVENTION

The present invention relates to automatic washers and more particularly, to horizontal axis automatic washers having a rotatable basket having asymmetrical door flaps cooperating with a front angled enclosure access opening.

Typically, horizontal axis automatic washers employ either a front loading or a top loading configuration for receiving clothes items to be washed. U.S. Pat. No. 3,197,980 to Marple, assigned to the assignee of the present invention, shows a typical front loading horizontal washer wherein the horizontal wash basket is accessed through one of the vertical end walls of the horizontal basket and the front surface of the washer enclosure.

The preference of many consumers, however, particularly those in the U.S., is for top loading washers. U.S. Pat. Nos. 4,862,712 to Huttemann and No. 3,908,412 to de Hedouville, show typical horizontal axis washers having a top loading horizontal axis basket.

Existing top loading horizontal axis washers, however, have some drawbacks. In the typical top-loading horizontal washer, clothes items must be raised to the level of the top surface of the washer in order to be loaded into the basket. Further, as shown by both Hutteman and de Hedouville, a relatively small opening in the basket is provided for accessing the interior of the basket. The typical basket opening in a top loading horizontal washer has a basket opening extending substantially less that 90°. Additionally, as shown in both of the above cited references, the basket door of the typical top loading horizontal axis washer consists of two door flaps. These door flaps, when in their open position, extend upwardly and require a lengthy tub access conduit so that they do not extend above the top surface of the washer and impede access into the wash basket. Further, to close these door flaps from an open position, both door flaps must be urged downwardly at the same time requiring two hands for operation.

These and other drawbacks, increase the difficulty of accessing the interior or the wash basket for loading and unloading clothes. There exist, therefore, a need for a top loading horizontal axis washer having improved interior wash basket accessibility.

There are some example in the prior art of washers having alternate designs for providing interior basket accessibility. For example, U.S. Pat. No. 2,895,320 shows a washer having a diagonal axis wash basket providing wash basket access on an angled front cabinet surface. U.S. Pat. No. 3,240,038 discloses a horizontal axis washer having a front curved surface and a front curved door for accessing a horizontal basket which also has a front curved shell-type door covering an opening in the rotatable basket.

None of these references, however, truly provide a top loading horizontal washer with easy accessibility into the wash basket. Thus it is apparent that a new type of top loading horizontal washer is desirable to overcome the short-comings of the prior art.

SUMMARY OF THE INVENTION

One object of the invention is to improve accessibility into a wash basket for a top loading horizontal axis washer.

Another object is to provide a top loading horizontal washer having a large access opening partially extending along the top and front surfaces of the washer for providing a front angled access.

Another object is to provide a top loading horizontal axis washer having a relatively large diameter wash basket in comparison to the overall height of the washer.

A further object of the invention is to provide a top loading horizontal washer having door flaps configured to not impede access into the interior of the washer basket.

Still another object is to provide a top loading horizontal wash basket having door flaps configured to be moved from an open position to a closed position with a single handed operation.

According to the present invention, the foregoing and other objects are attained by an automatic washer having a tub including an opening for accessing the interior of the tub. An enclosure is provided surrounding the tub and having a front surface, opposing side surfaces and a top surface. The enclosure further includes an access opening extending partially along the front surface and the top surface such that the access opening has a front edge disposed on the front surface of the enclosure and a rear edge disposed on the top surface. A lid, extending along the top surface and partially down the front surface in the closed position, is connected to the enclosure for selectively closing and opening the access opening.

A cylindrical basket is rotatably mounted within the tub for rotation about a horizontal axis which extends between the opposing side surfaces. The basket includes an opening having opposite front and rear edges. A first door flap is hingedly mounted on the rear edge of the basket opening and has an arc length substantially equal to the arc length of the basket opening. A second door flap is hingedly mounted opposite the first door flap on the front edge of the basket opening and has an arc length less than $\frac{1}{3}$ the arc length of the first door flap. The first door flap is positioned in its open position adjacent the lid in its open position and the second door flap is positioned adjacent the front edge of the access opening in its open position such that both the first and second door flaps are positioned out of the path of loading and unloading clothes items into the wash basket, The door flaps are further configured to both include front edge portions opposite their hinged connection with the basket opening, The second door flap is positioned in its open position at a predetermined angle such that the front edge portion of said second door flap projects into the arc traced by the front edge portion of the first door flap when the first door flap moves from an open position to a closed position such that the first and second door flaps may be moved from an open position to a closed position by downwardly urging the first door flap.

BRIEF DESCRIPTION OF THE DRAWINGS

FIG. 9 is an enlarged side elevational view taken along lines IX—IX in FIG. 5, showing the latching mechanism of the present invention.

FIG. 10 is a sectional view taken along line X—X in FIG. 9.

DESCRIPTION OF PREFERRED EMBODIMENT

Figure 1:
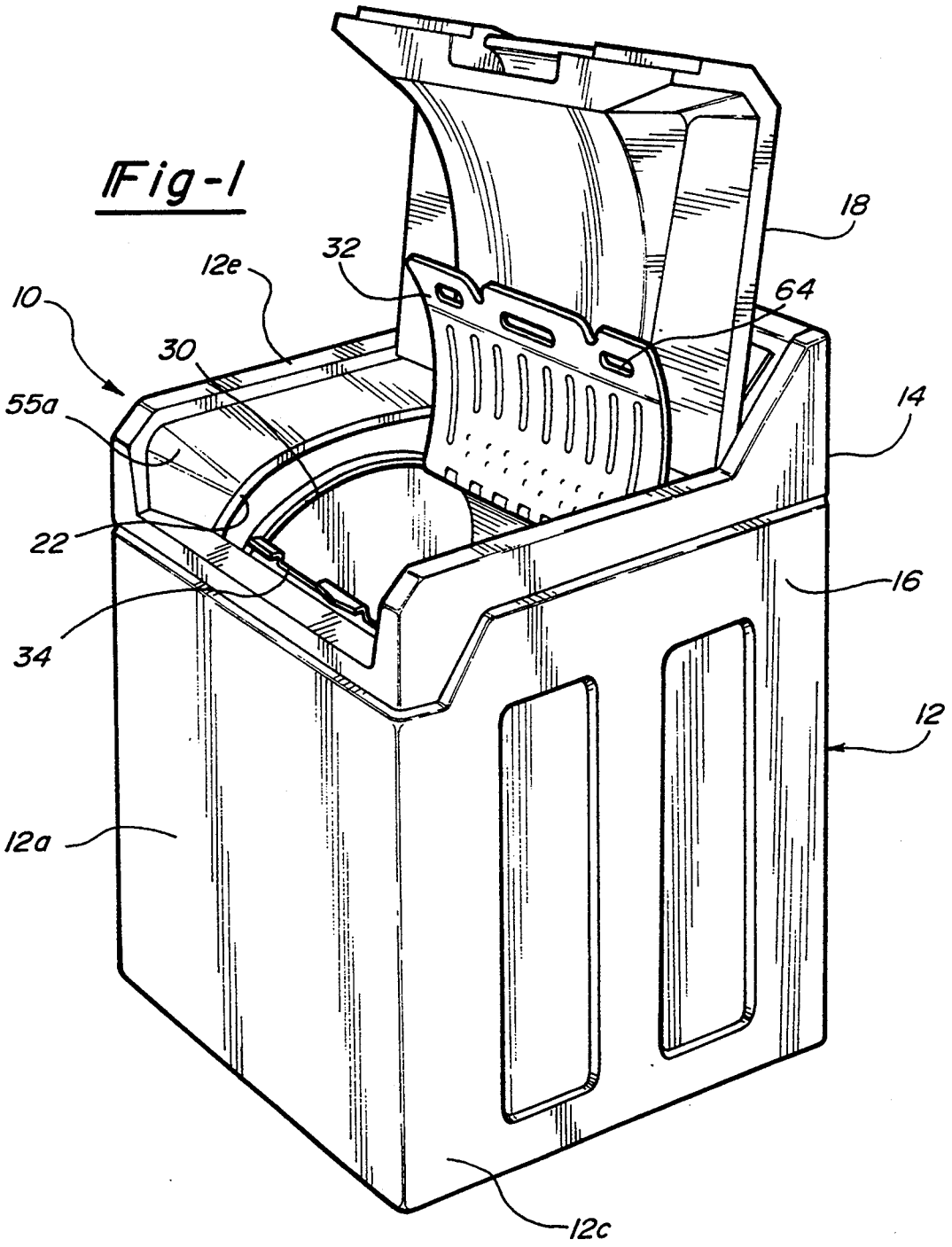
FIG. 1 is a top, front and side perspective view of the automatic washer embodying the present invention having the lid and basket door flaps shown in the open position.
Figure 2:
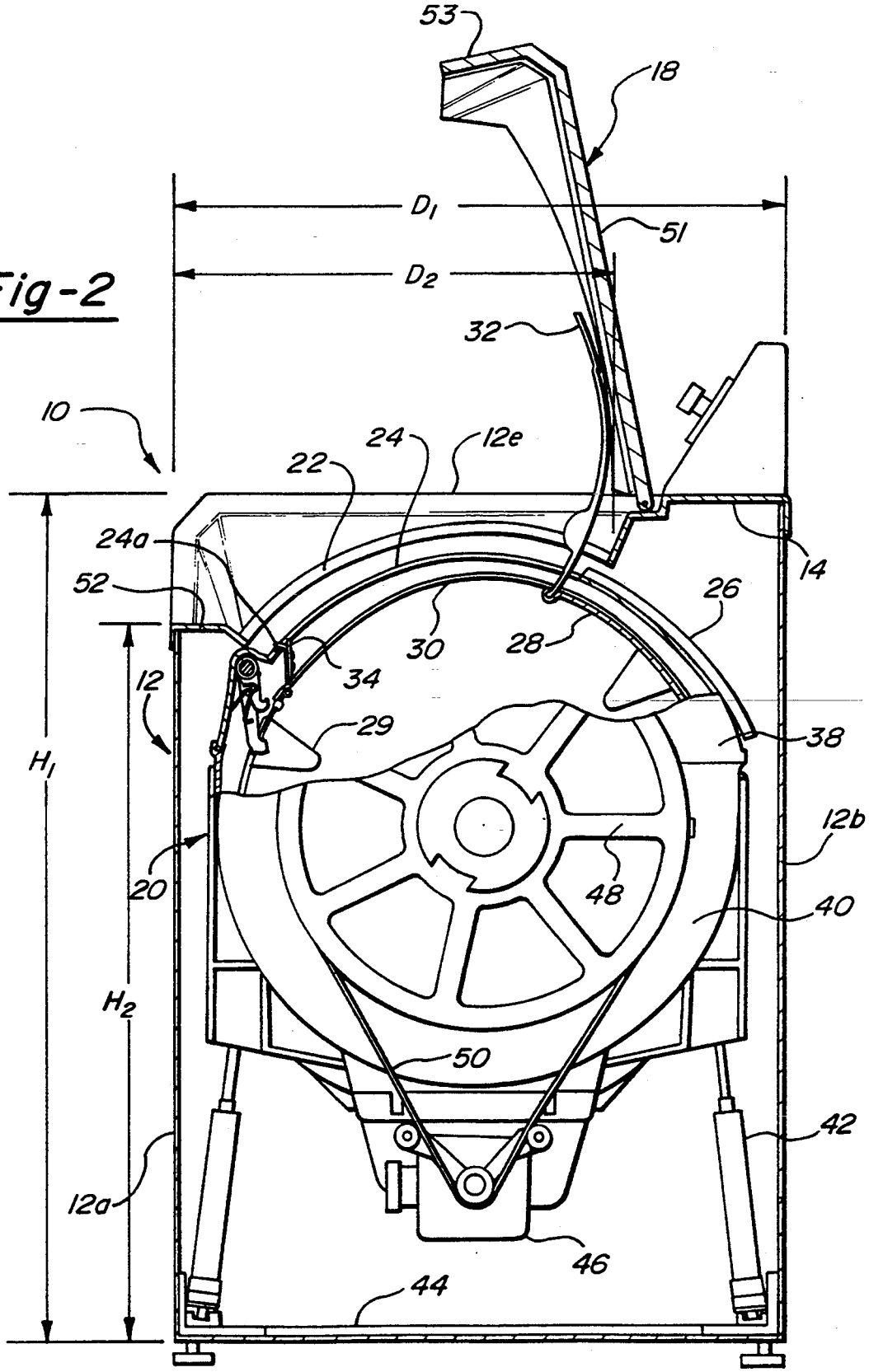
FIG. 2 is a partially cut away side elevational view of the automatic washer of FIG. 1.

In FIGS. 1 and 2, there is illustrated a top-loading drum-type automatic washer 10 embodying the principles of the present invention. The washer 10 has an enclosure 12 generally defining a front surface 12*a*, a back surface 12*b*, opposite side surfaces 12*c* and 12*d* and a top surface 12*e*. The enclosure includes a top member 14, an outer cabinet 16 and an openable lid 18, shown in an open position, which encloses an imperforate wash tub 20. The top member 14 includes an access opening 22 extending partially along the top surface 12*e* and the front surface 12*a* for accessing the interior of the enclosure 12. The wash tub 20 has an upwardly orientated rectangular tub opening 24 having a front edge 24*a*. The opening 24 is aligned with the access opening 22 and a slidable wash tub lid 26, shown in an open position, is provided for sealably closing the opening 24.

Disposed within the wash tub 20 is a rotatable, perforate wash basket 28 having a rectangular basket opening 30 provided with an openable first door flap 32 and an openable second door flap 34. Each door flap includes a free edge portion 32*a* and 34*a*, respectively. The door flaps 32 34, shown in an open position, may be aligned with the tub opening 24 for allowing access into the wash basket 28 such that clothes may be loaded and unloaded from the wash basket 28. A plurality of baffles 29 may be disposed within the basket 28, attached to the inner surface of the basket 28 and extending inwardly for enhancing the tumbling action of the clothes items within the basket 28 during a wash cycle.

The general construction of the rotatable basket 28 and balancing disks 36 (FIG. 5) are shown and described in pending U.S. patent application Ser. No. 07/997,435, Farrington et al., the specification of which is herein incorporated by reference. The wash tub 20 is formed by a two piece construction including an upper tub member 38 and a lower tub member 40. The tub 20 is supported within the enclosure 12 by struts 42 extending from the lower tub member 40 to a frame 44. A motor 46 is supported from the lower tub member 40 and is drivably connected to a pulley 48 by a belt 50. The pulley 48 is drivably interconnected with the basket 28 such that the motor 46 may rotate the basket 28 within the tub.

The automatic washer 10 is configured to ease loading and unloading of clothes items into the wash basket 28. As described above, the access opening 22 is configured to extend partially along the top surface 12*e* and front surface 12*a* such that clothes items being loaded and unloaded from the wash basket 28 must be raised only to the height of a front lip portion 52 of the top member 14 to pass through the access opening 22. The ratio of the overall height H1 of the enclosure 12 to the distance H2 from the bottom of the enclosure 12 to the front lip portion 52, when measured in like units, is approximately 1.16. Further, the access opening 22 extends along the top surface 12*e* such that the ratio of the overall depth D1 of the automatic washer 10 to the overall length D2 of the access opening 22 is 1.4. It can be seen, therefore, that access opening 22 provides a relatively large front angled opening for accessing the interior of the wash basket 28.

The lid 18 is configured to completely cover the access opening 22. The lid therefore includes a first portion 51 extending along the top surface 12*e* and a second portion 53 extending along front surface 12*a*.

The top member 14 includes downwardly sloped side interior walls 55*a* and 55*b* which are disposed along the side edges of the access opening 22. These side interior walls extend from the top surface 12*e* to the edge of the access opening 22 for providing a funnelling effect such that clothes being loaded into the wash basket 28 are downwardly directed under the urgings of gravity along the side interior walls 55a and 55*b* into the wash basket 28.

Figure 3:
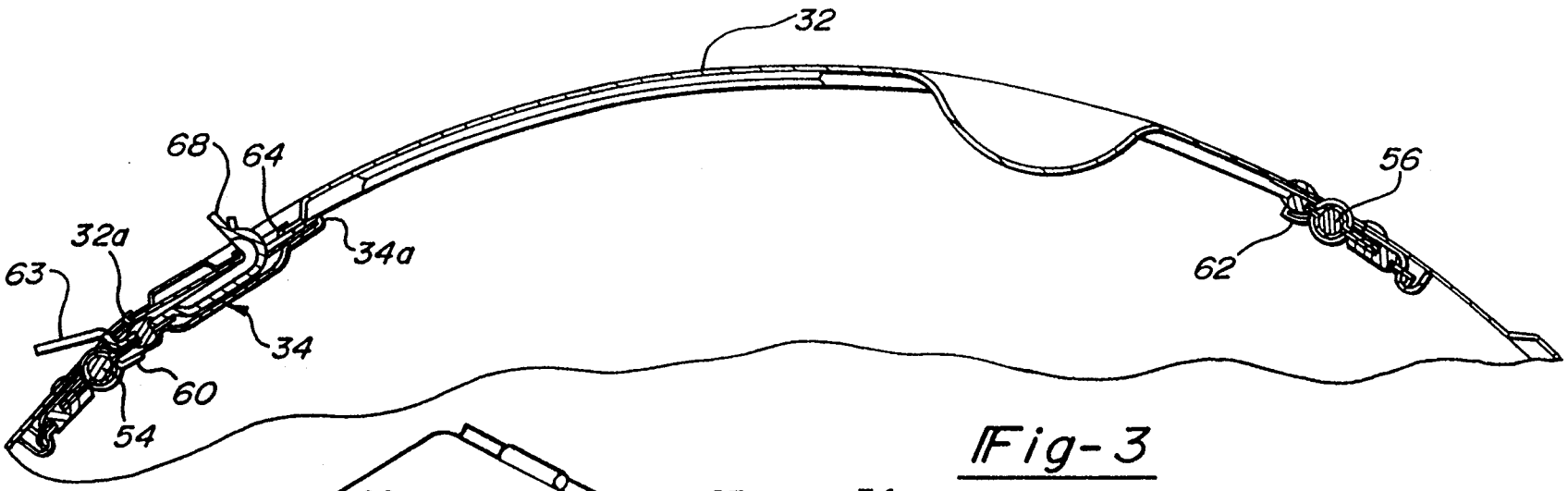
FIG. 3 is a sectional view of the door flaps of the wash basket with the door flaps partially disengaged.

The door flaps 32 and 34 are configured to further enhance operator access into the wash basket 28. As best seen in FIGS. 2 and 3, the first door flap 32 is relatively large, having an arc length approximately equal to size of the basket opening 30. The second door flap 34 is relatively small in comparison to the first door flap 32. As contemplated by the inventors, the first door flap 32 has an arc length of approximately 13" and the second door flap 34 has an arc length of approximately 3". The door flaps are hinged at mutually opposite edges 30*a* and 30*b* of the rectangular opening 30 and are partially overlapped when they are closed. The door flaps 32 and 34 are curved throughout their width in such a way that, when they are in their closure position, the outline of the flaps 32 and 34 does not project beyond the circular outline of the basket. At respective hinge points 54 and 56, the door flaps 32 and 34 are also provided with a least one respective torsion spring 60 and 62 for urging their respective door flaps upwardly into its open position. Extending from the second door flap 34 is a tab 63 for limiting the rotation of the second door flap 34 about the hinge point 54.

When the basket opening 30 is correctly aligned with the tub opening 24, the door flaps may be opened for allowing access through the opening 30 into the interior of the basket 28. When the flaps 32 and 34 are opened, the second door flap 34 is urged upwardly and is positioned adjacent the front edge 24*a* of the tub opening 24. The tab 63 limits the rotational travel of the second door flap 34 and positions the second door flap 34 partially closed at a predetermined angle relative to a tangential line to the basket 28 having the hinge point 54 as a tangent point. The predetermined angle is preferably approximately 45°. The first door flap 34 is also urged upwardly when opened and is rotationally limited and positioned against the lid 18. It can be seen, therefore, that the asymmetrical configuration of the door flaps is such that the door flaps 32 and 34, when opened, do not hinder access into the interior of the wash basket 28. Specifically, the second door flap 34 extends just beyond the front edge 24*a* but does not interfere with loading and unloading clothes due to its small size while the much larger second door flap is positioned against the lid 18 out of the path of loading and unloading clothes items into the wash basket 28.

Closure of the door flaps 32 and 34 is achieved by downwardly forcing the open first door flap 32. The resultant downward rotation of the first door flap causes the free edge 32*a* of the first door flap 32 to catch the free edge 34*a* of the second door flap 34. This is possible due to the fixed angle, partially closed position in which the second door flap 34 is held by tab 63 when in its open position, which positions the free edge 34*a* of the second door flap 34 in the arc traced by the free edge 32*a* of the first door flap 32 when the first door flap. 32 is moved from an open position to a closed position. In this fashion, both of the door flaps 32 and 34 may be engaged by only downwardly urging the first door flap 32.

Figure 4:
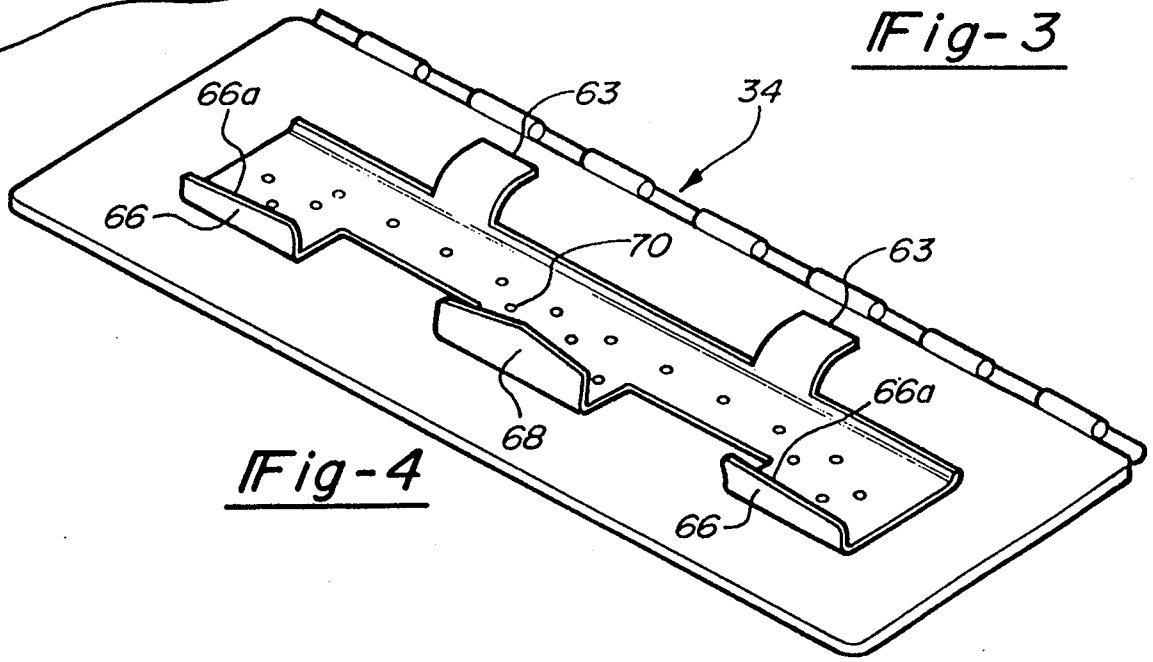
FIG. 4 is a top, front and side perspective view of the second door flap of the present invention.

As shown in FIGS. 3 and 4, apertures 64, side hook members 66 and center hook member 68 are respectively provided along the free edges 32*a* and 34*a* of the door flaps in such a position as to permit the apertures 64 and hook members 66 and 68 to engage each other when the first door flap 32 is pushed downwardly. The hook members are configured to provide a highly reliable latching system for the door flaps 32 and 34 wherein all of the hook members properly engage their respective apertures. It can be seen that the hook members 66 and 68 have been tapered from a center point 70 such that the center hook 68 is the tallest hook member and has a vee shaped contact point. In this fashion, the center hook 68 is the first hook to engage its respective aperture even if the first door flap is twisted or forced downwardly with an off-center force. The side hooks 66 are configured having a s-curved shape wherein the top edges 66*a* of the side hooks are bent forward, away from premature contact and engagement with the matching first door flap piece. With the s-curve shape, the side hooks 66 are further prevented from latching prior to the center hook 68.

The above described door flap and basket construction allows for a relatively large diameter wash basket 28 in comparison to the overall height of the washer 10. Typically, in order to prevent the door flaps of a top loading horizontal washer from interfering with basket access, a lengthy tub access conduit is provided, extending from the top surface of the washer to the basket opening. However, due to the above described structure, in the present invention the basket opening 30 can approach the top surface 12*e* of the washer 10 such that the basket opening 30 is positioned relatively close to the top surface 12*e* of the washer. This allows the basket diameter to be relatively large in comparison to the overall height of the washer 10. As contemplated by the inventors, the ratio of overall height H1 of the enclosure 12 to the diameter of the basket 28, when measured in like units, is approximately 1.7.

Figure 5:
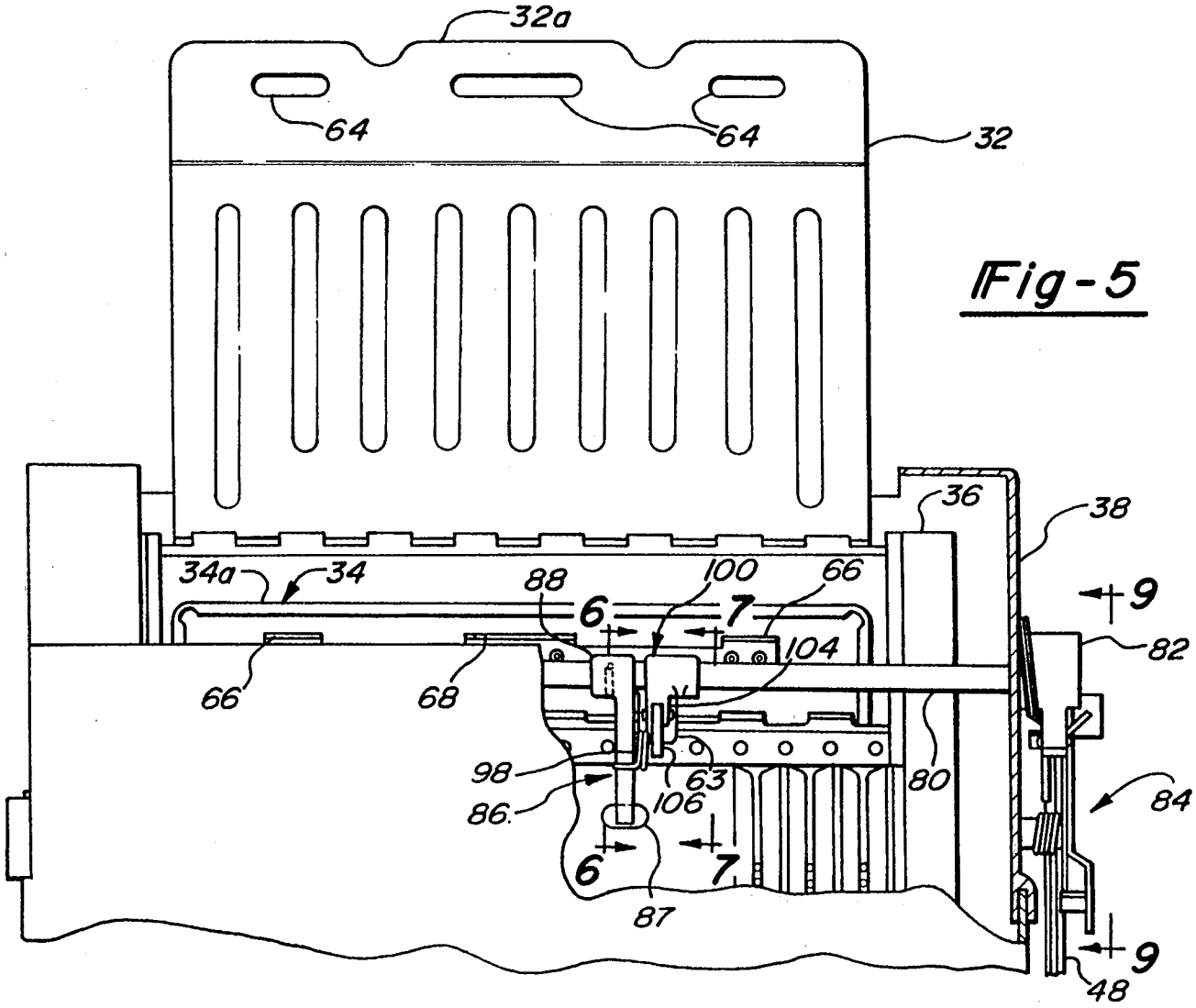
FIG. 5 is a partially cut away front elevational view of the wash tub and wash basket of the present invention.
Figure 6:
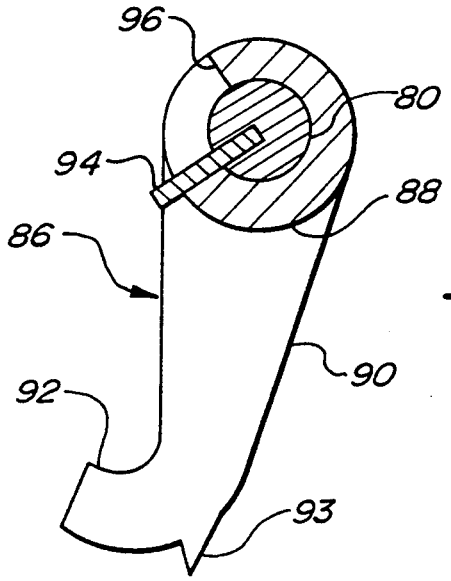
FIG. 6 is a sectional view taken along lines VI—VI in FIG. 5.
Figure 7:
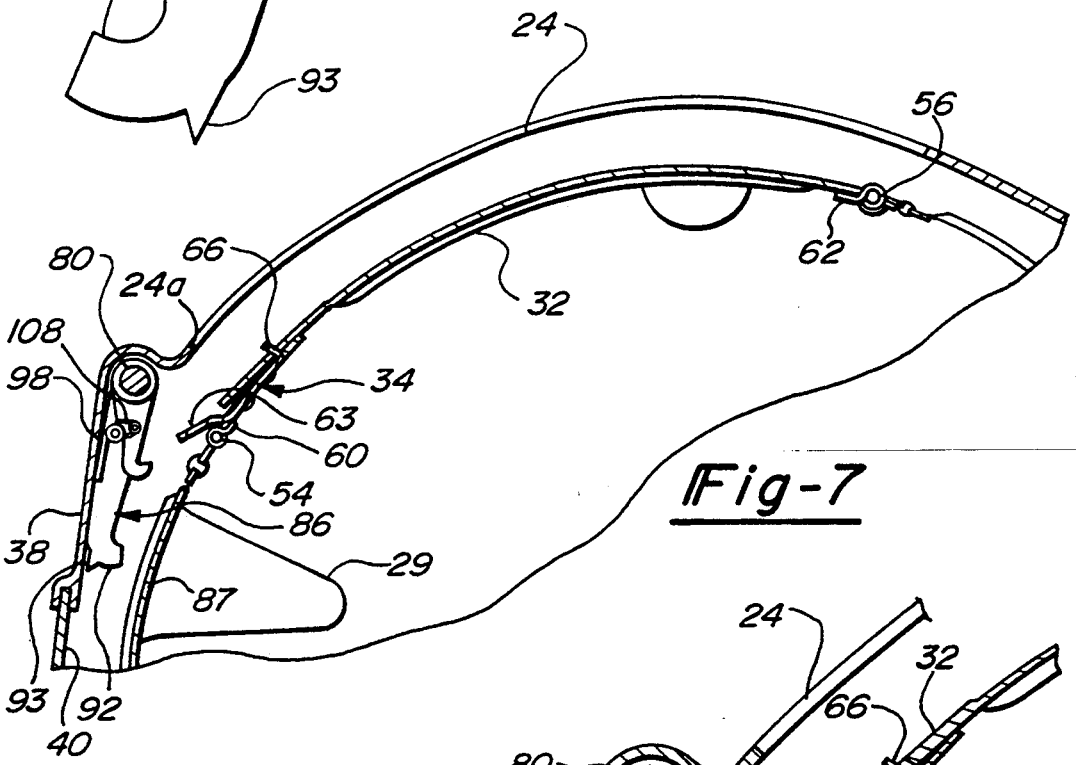
FIG. 7 is a sectional view of the door flaps, wash basket and tub of the present invention with the door flaps in their engaged position.

Turning now to FIG. 5–7, a control shaft 80 is shown supported within the tub 20 and disposed adjacent the rotatable basket 28. The control shaft 80 is rotatably supported at opposite ends by the upper tub member 38 and includes at least one end extending through the upper tub member 38 wherein a rotary positioning member or rotary positioning hub 82 is secured to the control shaft 80 outside the upper tub member 38. A latching mechanism 84 is provided adjacent the hub 82 for latching the hub 82 in a predetermined position, as described in detail herein further below. The hub 82, latching mechanism 84 and pulley 48 are shown disposed on the right hand side of the tub 20 but could be disposed on the opposite side and function in an identical fashion, as can be understood by one skilled in the art. The below description makes frequent reference to rotational directions by using the terms "clockwise" and "counter-clockwise". It can be understood by those skilled in the art that these terms are used with respect to a right side view perspective as illustrated in FIGS. 7, 9, 11, and 14–17.

The control shaft 80 supports a holding arm 86 adjacent the rotatable basket 28 which may be controlled for engaging a stop opening 87 provided in the wash basket 28 for positioning the basket 28 during loading and unloading. As shown, one of the baffles 29 may be preferably positioned over the stop opening 87. As best shown in FIG. 6, the holding arm 86 includes a boss portion 88 surrounding the control shaft 80 and a leg portion 90 having a hook-like catch portion 92 provided at the end of the leg portion 90. An engagement finger 93 is provided extending from the catch portion 92 for limiting engagement of the holding arm 86 with the basket stop opening 87. A pin 94, extending from the control shaft 80, engages a slot 96 provided on the boss 88 of the holding arm 86 for controlling relative rotation of the holding arm 86 about the control shaft 80. In this fashion the control shaft 80 may rotate within the holding arm boss portion 88 while the holding arm 86 remains angularly fixed. A torsion spring 98 is provided for urging the holding arm 86 toward the basket 28 in a counter-clockwise direction.

A tab engagement arm 100 is also supported by the control shaft 80 adjacent the basket 28 which may be controlled for engaging the tab 63 extending from the second door flap 34 wherein the door flaps 32 and 34 may be released from a closed position to an open position. As seen in FIGS. 5 and 7, the tab engagement arm 100 includes a drive arm member 104 which is rigidly secured to the control shaft 80 for rotation therewith, and a tab hook 106 being hingedly mounted at the end of the drive arm 104. A spring 108 is provided for biasing the tab hook 106 toward the basket 28 wherein the tab hook 106 is positioned by the hinged connection and the spring 108 to extend straight from the drive arm 104 radially away from the center of the drive shaft 80.

Figure 8:
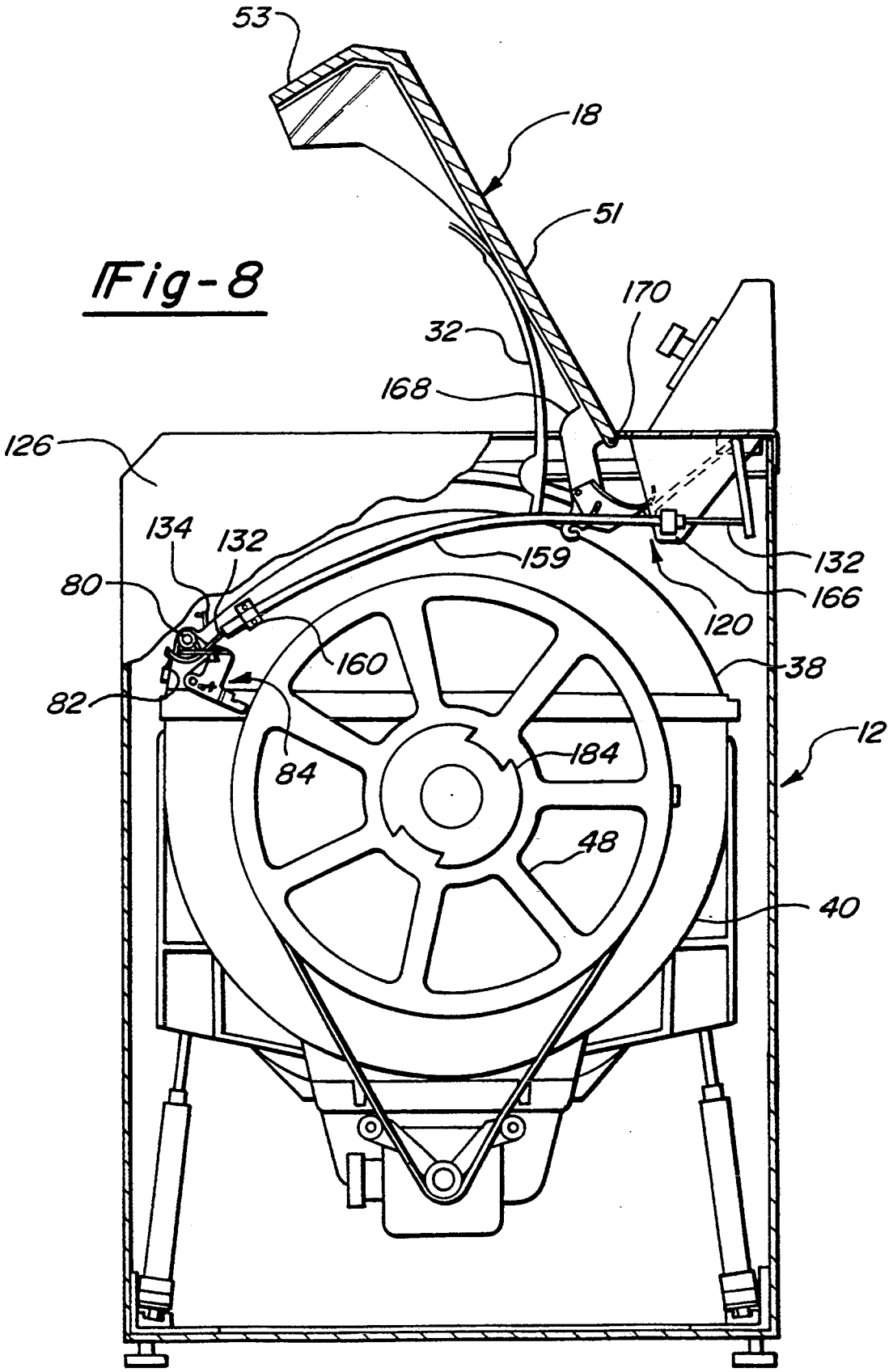
FIG. 8 is a partially cut away side elevational view of the automatic washer of FIG. 1.
Figure 11:
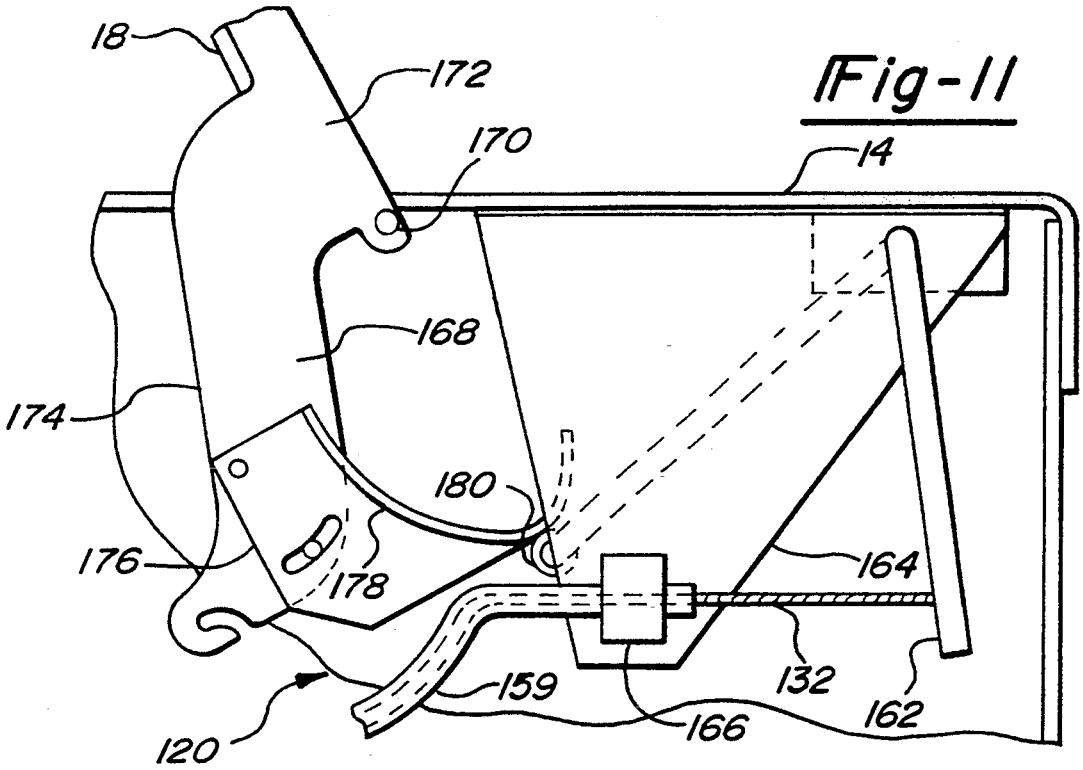
FIG. 11 is an enlarged side elevational view showing the lid mechanism of the present invention.

Turning now to FIG. 8, the hub 82 attached to the control shaft 80 is shown along with the latching mechanism 84 and a lid mechanism 120. These systems operate to control the rotation of the control shaft 80 to actuate the holding arm 86 and the tab engagement arm 100 for positioning the basket 28 and opening the door flaps 32 and 34, as will be described herein below.

In FIGS. 9 and 10, the hub 82 is shown in detail, held in its engaged position by the latching mechanism 84. The hub 82 is preferably a thermoplastic member and is secured to the control shaft 80 by a screw 123. A torsion spring 124 is provided for urging the hub 82 to rotate clockwise as shown. The torque applied to the control shaft 80 by spring 124 is less than the torque applied to the shaft by spring 98. The hub 82 is generally fan shaped and includes a notch 126 and an outer surface 127. A hook portion 128 is provided along with a cable guide surface 130 such that a cable 132, extending from the lid mechanism 120, may be secured to the hub 82. A hub switch 234 is secured to the upper tub 38 adjacent the hub 82 for sensing rotation of the hub. In particular, the orientation of the hub switch 234 is such that rotation of the hub 82 corresponding to engagement of the holding arm 86 into the stop opening 87 is sensed.

The latching mechanism 84 includes a latching lever 134 and a tripping lever 136. These levers are contemplated to be metallic and formed by a sheet steel stamping operation. The levers 134 and 136 are disposed adjacent to each other and are rotatably secured to the upper tub member 38 by a shaft 138 having a threaded retaining end 140. The latching lever 134 is provided with a catch flange 142 for engaging the notch 126 provided on the hub 82. A torsion spring 144 is provided for urging the latching lever 134 toward the hub 82. The latching lever 134 is further provided with a tab 145 which extends from the lever 134 outwardly through a slot 146 provided in the tripping lever 136. In this fashion, the levers 134 and 136 are free to rotate a small angular distance relative to each other. A spring 149 is provided for urging the latching lever 134 counter-clockwise toward the hub 82 relative to the tripping lever 136.

The tripping lever 136 is provided with a first arm portion 147 extending toward the pulley 48 and a second arm portion 148. The second arm portion 148 is provided with a flange portion 150 having a hole 152. A connecting rod 154 interconnected with the hub 82 extends through the hole 152 of the flange 150. A spring 156 is positioned between the flange 150 and a collar 158 provided on the rod 154, such that the hub 82 and tripping lever 136 are resiliently interconnected with each other.

As mentioned above and shown in FIG. 8 and 11, the lid mechanism 120 may operate to control the rotation of the control shaft 80 when the basket 28 is positioned and the holding arm 86 is in the stop opening 87. The lid mechanism 120 is interconnected directly to the hub 82 by the cable 132 which may be enclosed in a casing 159 wherein the casing 159 is secured to the upper tub 38 by bracket 160. The cable 132 is attached to a cam follower lever 162, at the end opposite attachment to the hub 82. The cam follower lever 162 is rotatably supported by a cam bracket 164 which is secured to the top 14 and which also provides a surface for attaching a bracket 166 which slidably supports the cable 132.

Extending from lid 18 is a lid hinge 168 which hingedly connects the lid 18 with the top 14 at hinge point 170. The lid hinge 168 includes a first portion 172 secured to the lid 18 and a second portion 174 extending beyond the hinge point 170 which supports a lid hinge cam 176. The lid hinge cam 176 includes a cam surface 178 which slidably engages a cam follower end 180 of the cam follower lever 162. The cam surface 178 is configured such that moving the lid from a closed position to an open position causes the cam surface to engage the cam follower end 180 such that the cable 132 is moved from a first rest position to a second forward position and back to the first rest position.

Figure 12:
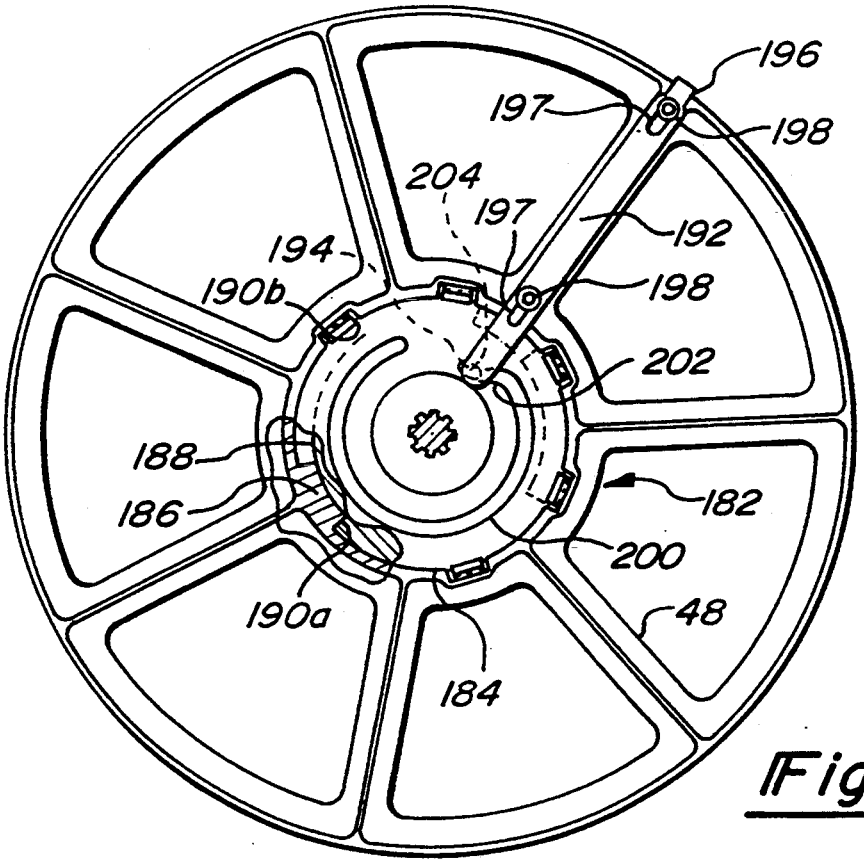
FIG. 12 is a side sectional view showing the inner face of the pulley and the tripping mechanism of the present invention wherein the tripping mechanism is in a disengaged position.
Figure 13:
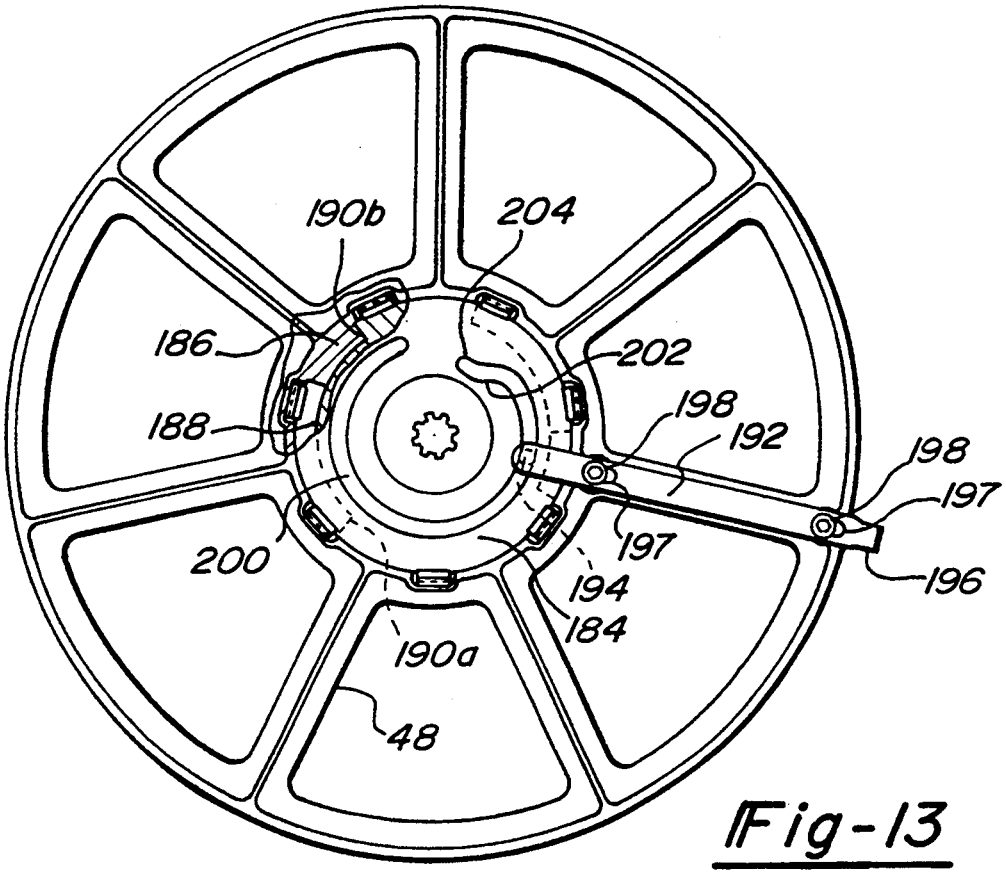
FIG. 13 is a side sectional view showing the inner face of the pulley and the tripping mechanism of the present invention wherein the tripping mechanism is in an engaged position.

In FIGS. 12 and 13, the inward face of the pulley is shown including a tripping mechanism 182. The tripping mechanism 182 is associated with the pulley 48 and operates to trip the latching mechanism 84 and to reset the latching mechanism 84. The tripping mechanism 182 is designed such that during normal clockwise rotation of the pulley 48, no engagement with the latching mechanism occurs. However, when access to the basket 28 is desired, rotation of the pulley 48 is reversed to a counter-clockwise rotation wherein the tripping mechanism 182 engages the latching mechanism 84 so that the holding arm 86 is released to engage the stop opening 87 for positioning the basket 28. When the rotation of the basket 28 is desired to be resumed, the tripping mechanism 122 operates to again engage the latching mechanism 84 to reset it, drawing the holding arm 86 away from the basket 28.

Pulley rotation is required for causing the tripping mechanism 182 to trip and reset the latching mechanism 84. However, it can be understood that until the latching mechanism 84 is reset, drawing the holding arm 86 out of the stop opening 87 of the basket 28, the basket 28 can not rotate. Therefore, a two piece pulley system is required which provides for lost motion of the basket 28 while the pulley 48 rotates to resent the latching mechanism 84.

The pulley 48, therefore, is slidingly disposed about a drive hub 184 which is rigidly attached to a basket drive shaft 185 for driving the basket 28. The pulley 48 is supported by the drive hub 184 in such a manner that limited relative rotation between the drive hub 184 and the pulley 48 may occur. To accomplish this limited relative rotation, the pulley 48 is provided with a inwardly extending drive dog 186 which rides within a slot 188 provided on the outer diameter of the drive hub 184. End walls **190*a* and 190*b* are provided in the slot 188 for interfering with the movement of the drive dog 186 within the slot 188 such that the pulley 48 may rotate a limited angular distance relative to the drive hub 184 and then engage the hub for co-rotation. It is contemplated by the inventors that the pulley 48 and drive hub 184** may be constructed of different types of plastic material and slidingly engage each other along their inner and outer periphery, respectively.

The tripping mechanism 182 further includes a trip arm 192 having a cam follower end 194 and a trip end 196. The trip arm 192 includes slots 197 through which shouldered fasteners 198 are placed for securing the trip arm 192 to the pulley 48 for allowing axial movement of the trip arm 192 relative to the pulley 48. The cam follower end 194 is positioned in a track 200 provided in the drive hub 184. The track 200 includes a cam portion 202 and and inner track 204.

Remembering that FIG. 12 and FIG. 13 illustrate the internal or inward face of the pulley 48 and therefore rotational directions appear to be reversed, it can be seen in FIG. 12, that when the pulley 48 is driven in a clockwise direction for driving the basket 28, the pulley 48 rotates around the drive hub 184 until the drive dog 186 is driven into the end wall 190*a*. This rotation of the pulley 48 around the drive hub 184 positions the cam follower end 194 within the inner track 204 wherein the trip end 196 is positioned in a first position such that the trip end 196 does not engage the latching mechanism 84 during the basket/pulley co-rotation. However, as shown in FIG. 13, when the direction of the pulley rotation is changed such that the pulley 48 is driven in a counter-clockwise rotation, the pulley 48 rotates about the hub 196 until the drive dog 186 is driven into the end wall 190*b*. This rotation of the pulley 48 around the drive hub 184 positions the cam follower end 194 within the track 200 wherein the trip end 196 is positioned in a second position having the trip end 196 positioned radially outward for engaging the latching mechanism when the trip end 196 is rotated past the latching mechanism 84.

Figure 14:
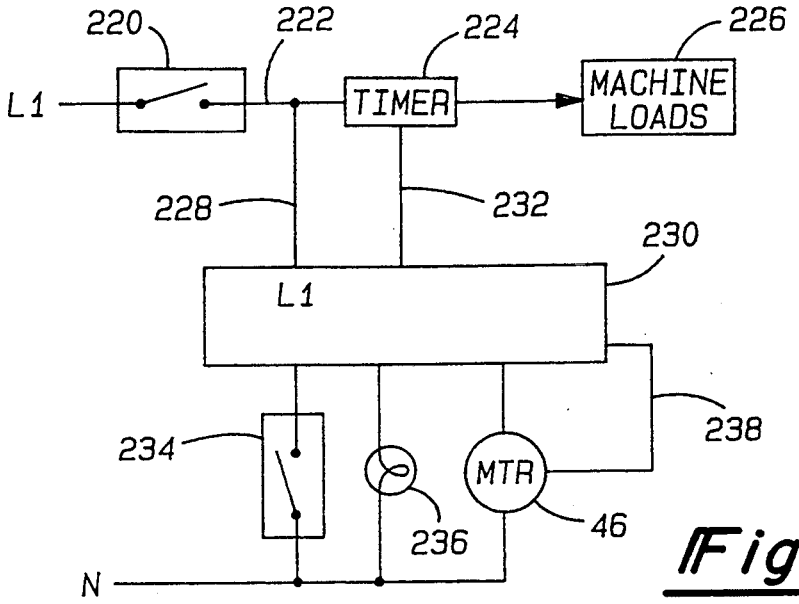
FIG. 14 is a circuit diagram for the automatic washer of FIG. 8.

FIG. 14 illustrates a simple circuit diagram for the above described automatic washer 10. A lid switch 220 is provided associated with the lid 18 for breaking the power supply to the automatic washer upon opening the lid 18. Line 222 connects the lid switch 220 with a timer 224 for controlling the operation of various components of the washer. The timer 224 includes a plurality of switches for controlling a plurality of machine loads 226, as is known. A line 228 extends from line 222 to a printed circuit board (PCB) or control board 230, including a microprocessor. Additionally, a line 232 extends from the timer to the control board 230.

As is known to one skilled in the art, the timer 224 contains a line switch (not shown) for energizing the timer such that closing the line switch energizes the timer and opening the line switch deenergizes the timer. Frequently, the timer line switch may be operated by the user by pushing/pulling on the timer knob. Once the timer is energized by closing the timer line switch, line 232 provides a 110 v signal input to the printed circuit board 230, which is energized through line 228. The control board 230 further receives a signal input from the hub switch 234 and selectively energizes an indicator light 236 and the motor 46. The motor may be a 220 v. DC variable speed universal motor. A tachometer feed-back line 238 provides a motor speed sensitive signal back to the control board 230. Included in the control board 230 is a reversing relay for operating the motor 46 in either a clockwise or counter-clockwise direction.

Figure 17:
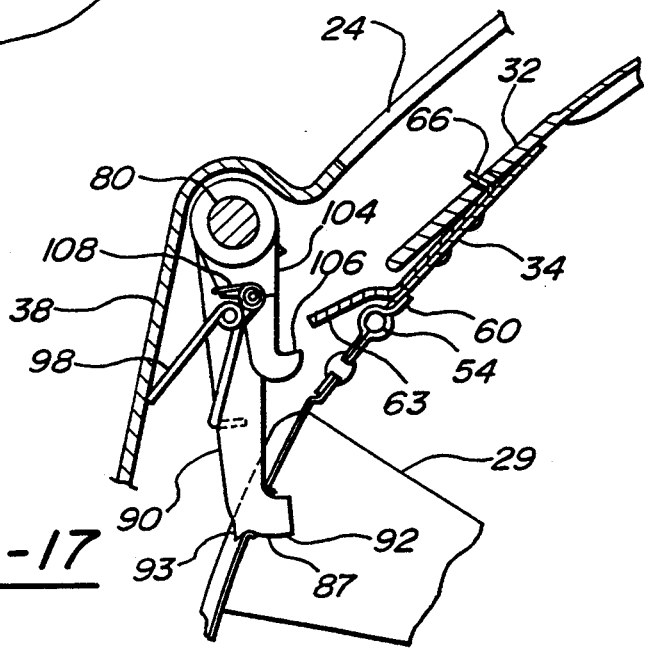
FIG. 17 is an enlarged sectional view showing the holding arm, hook assembly and door flaps of the present invention.
Figure 16:
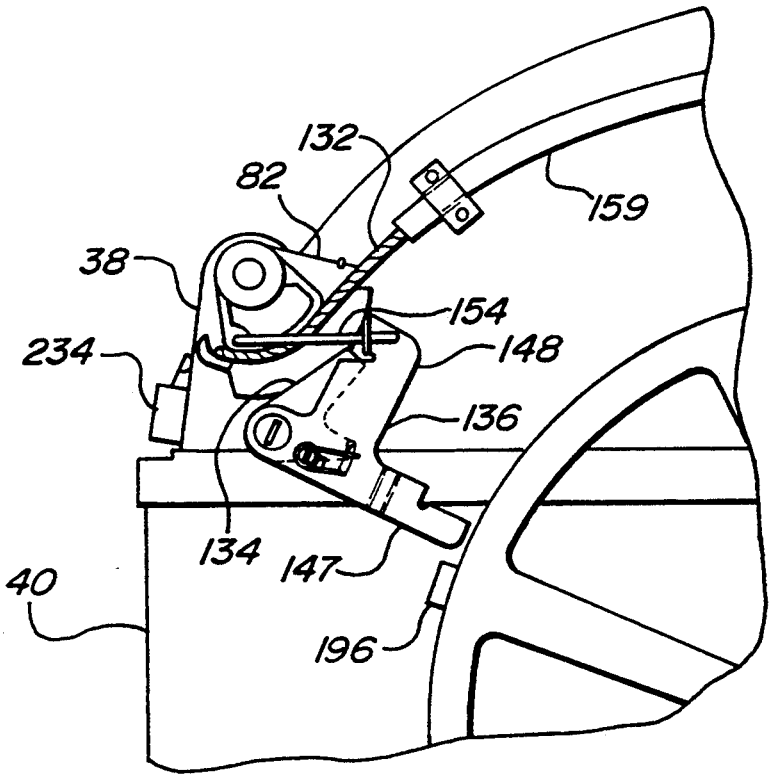
FIG. 16 is an enlarged partial side view of the tub of the present invention showing the cam in a disengaged position.
Figure 15:
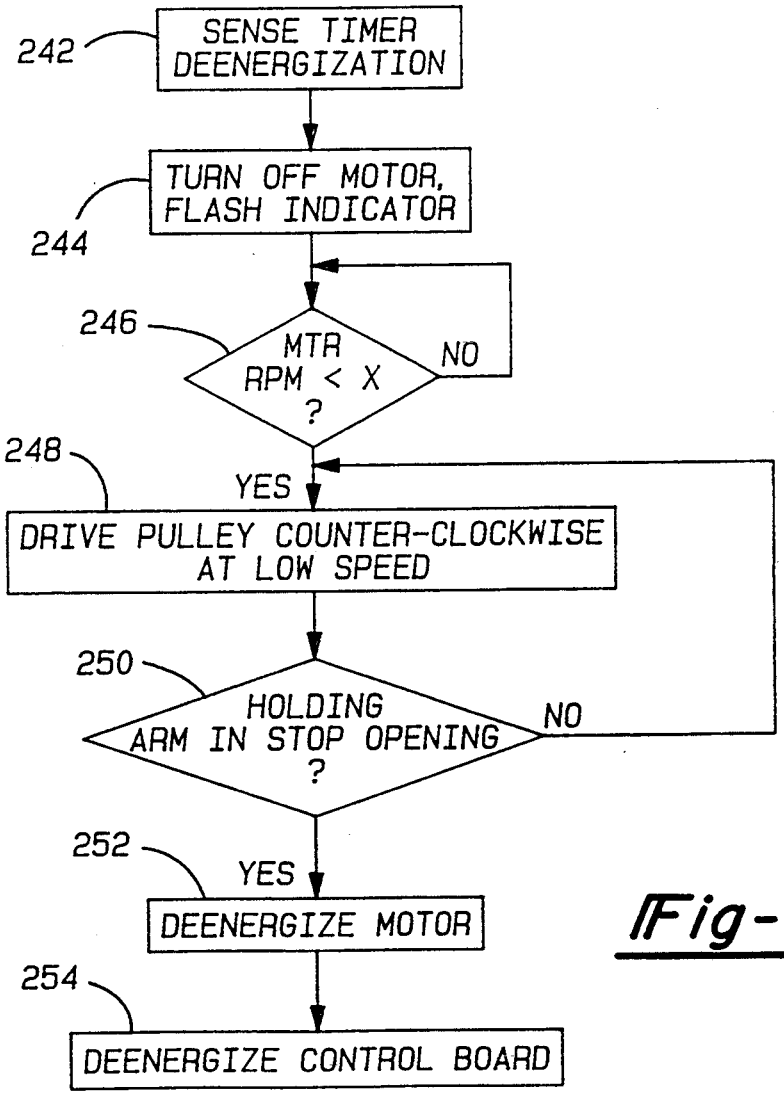
FIG. 15 is a flow chart illustrating the steps implemented by the control system of the washing machine of FIG. 8 to carry out a method of positioning the wash basket according to the present invention.

Turning now to FIGS. 15–17, the operation of the latching mechanisms 84, the lid mechanism 120, and the tripping mechanism 182 for causing rotation of the control shaft 80 may be shown. These mechanisms operate to automatically position and hold the basket 28 in its load/unload position as well as automatically opening the basket doors 32 and 34 when the lid 18 is opened. These operations, moreover, require only a basic control system as illustrated in FIG. 15.

During washer operation, the basket 28 must be free to to rotate within the tub 20 requiring that the holding arm 86 and tab engagement arm 100 be held in a disengaged position, away from the basket 28, as illustrated in FIG. 7. Corresponding to the disengaged position of the holding arm 86 and tab engagement arm 100, the hub 82 and control shaft 80 are held in a predetermined angular position, shown in FIG. 9, which may be termed angular position "A". It may be understood, therefore, that when the control shaft is held in the angular position "A", the holding arm 86 and the tab engagement arm 100 are positioned away from the basket 28 such that the basket 28 is free to rotate. The hub 82, is held, against the counter-clockwise rotational urgings of the spring 98, in its respective position by the engagement of the latching lever 134 with the notch 126 on the hub 82.

Wash basket auto-positioning and holding is initiated when the timer 224 is deenergized, as shown in step 242 of FIG. 15. Timer deenergization occurs automatically at the conclusion of a completed wash cycle and may also occur as a result of operator wash cycle interruption. In both cases, the timer line switch is opened, deenergizing the timer, which is sensed by the control board 230 through signal input line 232, as shown in step 242. In step 244, subsequent to the timer deenergization, the motor is deenergized and the indicator light 236 is flashed to signal to the user that the basket is being automatically positioned. Motor speed is sensed in step 246, determining when basket rotation has stopped or is less than a predetermined value. This basket "coast down" time may vary based on the wash load size and balance within the basket 28 and whether the basket 28 was in a high speed spin or low speed tumble. Motor speed sensing may be replaced by a simple hold time, long enough to ensure that basket rotation has slowed or stopped. Once the rotation of the basket 28 in a clockwise direction has slowed sufficiently or stopped, the pulley 48 is driven in a counter-clockwise direction by the motor 46, as shown in step 248.

As described above, driving the pulley 48 in a counterclockwise direction causes the trip end 196 of the tripping mechanism 182 to move to the second position, shown in FIG. 13, for engaging the first arm portion 147 of the tripping lever 136. As shown in FIG. 16, when the radially extended trip end 196 is rotated past the first arm portion 147, the trip end 196 engages the first arm portion 147 and causes the tripping lever 136 to rotate in a clock-wise direction about the shaft 138. The latching lever 134 rotates with the tripping lever 136 as a result of the engagement created by the tab 145 extending through the slot 146. The rotation of the latching lever pulls the catch flange 142 off of the notch 126 such that the hub 82 is disengaged from the latching lever 134 wherein, under the urgings of the spring 98, the hub 82 and the control shaft 80 rotate in a counter-clockwise direction.

As a result of this counter-clockwise rotation of the control shaft 80, the holding arm 86 is urged into the rotating basket 28. As shown in FIG. 17, engagement between the basket 28 and the holding arm 86 occurs upon alignment of the catch portion 92 of the holding arm 86 with the stop opening 87 in the basket 28. This position of the control shaft 80 maybe called angular position "B".

In step 250, holding arm engagement into the stop opening 87 is sensed by the hub switch 234. Alternately, holding arm engagement may be determined by sensing a locked rotor condition of the motor 46. Upon sensing that the holding arm 86 has engaged with the stop opening 87, the motor 46 is deenergized, as shown in step 252. Finally, in step 254, the control board 230 is deenergized which simultaneously deenergizes the flashing indicator light 236.

In step 250, holding arm engagement into the stop opening 87 is sensed by the hub switch 234. Alternately, holding arm engagement may be determined by sensing a locked rotor condition of the motor 46. Upon sensing that the holding arm 86 has engaged with the stop opening 87, the motor 46 is deenergized, as shown in step 252. Finally, in step 254, the control board 230 is deenergized which simultaneously deenergizes the flashing indicator light 236.

It can be understood, therefore, that simple rotation of the pulley 48 and the basket 28 in a reverse direction from the direction of rotation during the wash cycle, operates to secure the basket 28 in the desired position for loading and unloading clothes items. The use of the the trip arm 192 for releasing the latching mechanism 84 thereby actuating the holding arm 86 ensures that the holding arm 86 is driven into the rotating basket 28 just prior to alignment between the catch portion 92 with the stop opening 87. In this fashion, the holding arm 86 does not drag across a large portion of the outer circumference of the basket 28, which may result in undue holding arm wear, undue noise and possible misoperation. It can be seen, therefore, that the present invention provides a system requiring only a very basic control system for automatically positioning the basket 28 for loading and unloading clothes items.

Figure 18:
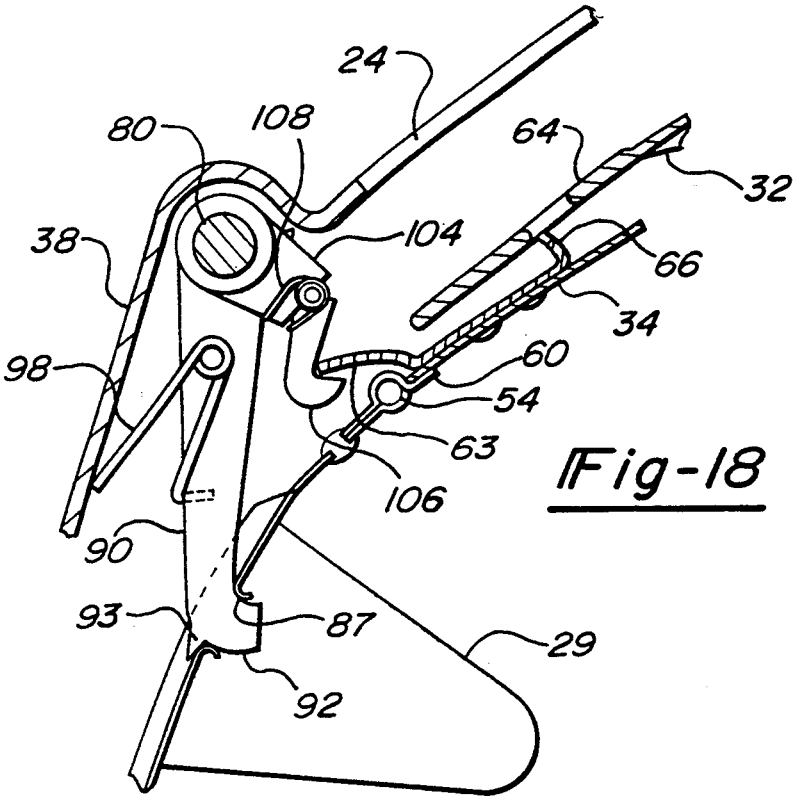
FIG. 18 is an enlarged sectional view showing the holding arm, hook assembly and door flaps of the present invention.
Figure 19:
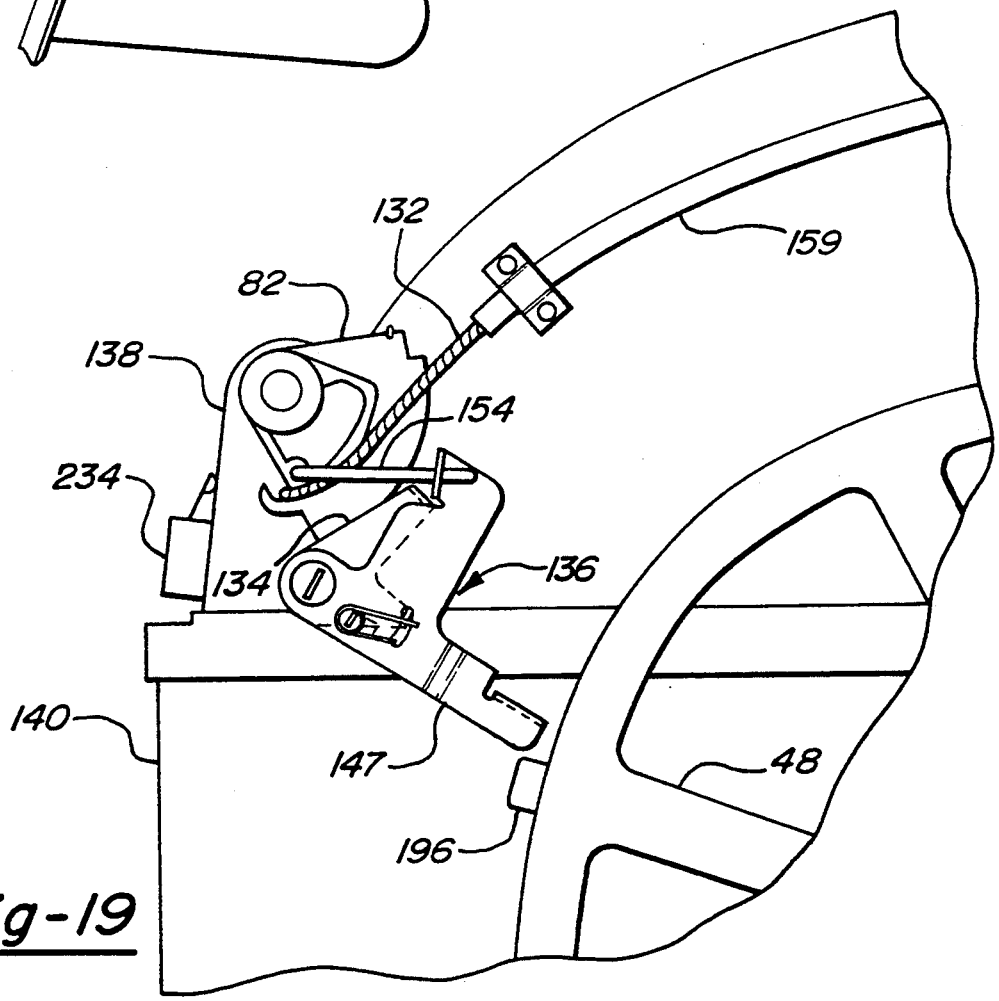
FIG. 19 is an enlarged partial side view of the tub of the present invention showing the cam in a fully rotated clockwise position.

Once the basket 28 is properly positioned and held as described above, the lid 18 may be opened for accessing the basket 28. As described above, the lid mechanism 120 is such that opening the lid 18 causes the cable 132 to move from its first rest position to its second forward position and back to the first rest position. FIGS. 18 and 19 show the effect moving the cable 132 to the second forward position has on the hub 82 rotation. As shown, the movement of the cable 132 to the second forward position rotates the hub 82 and control shaft 80 against the biasing of torsion spring 124 beyond the relative angular position "B" to a new angular position "C", such that the tab engagement arm 100 is driven to engage the door flap tab 63.

During rotation of the control shaft from position "B" to position "C" the holding arm 86 remains in its engaged position with the basket 28 while the control shaft 80 rotates relative to the holding arm 86. This is possible due to the pin and slot connection between the holding arm 86 and the control shaft 80, as described above. The resultant engagement between the tab hook 106 and the tab 63 rotates the second door flap 34 clockwise wherein the hooks 66 and 68 disengage from the apertures 64, such that the door flaps 32 and 34 are disengaged. Upon disengagement, the first door flap is urged open in response to the lid spring 56. Upon complete opening of the lid 18, the cable 132 is moved back to the first position, as described above, wherein the control shaft 80 returns to the angular position "B". This rotational movement back to angular position "B" causes the second door flap tab 63 to be released from the tab hook 106 whereupon the second door flap 34 is urged open by door spring 54.

In this fashion, therefore, opening the lid 18 results in the disengagement of the door flaps 32 and 34 such that the door flaps appear to open simultaneously with the opening of the lid 18 for accessing the basket 28. Further, the basket door opening system is a completely mechanical system, requiring no control logic or control system.

Figure 20:
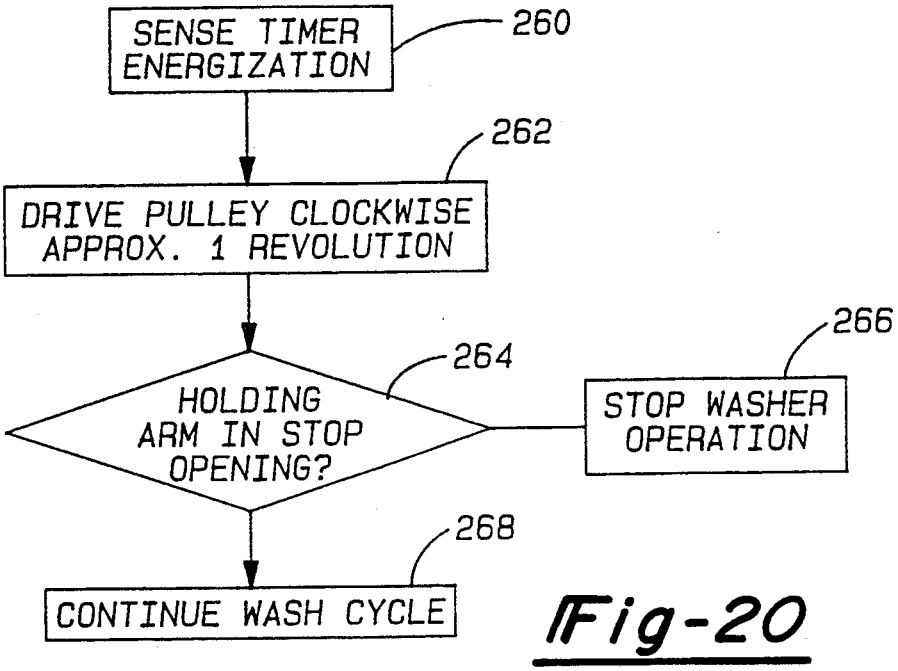
FIG. 20 is a flow chart illustrating the steps implemented by the control system of the washing machine of FIG. 8 to carry out a method of initiating basket rotation after the basket has been positioned and held.

Disengagement of the holding arm 86 from the stop opening 87 is necessary to re-initiate basket rotation after the interior of the basket 28 has been accessed. To accomplish this disengagement, the latching mechanism 84 must be reset from angular position "B" to angular position "A" such that holding arm 86 is disengaged from the basket 28. FIG. 20 illustrates the control sequence for reinitiating basket rotation during a washer power-up routine. As shown in step 260, the control board 230 senses timer energization. In step 262, the motor 46 is energized to drive the pulley clockwise approximately one revolution. Due to the above described basket positioning system, at the initiation of the washer power-up, when wash basket rotation is desired after the basket has been positioned and held, the trip arm 192 is positioned angularly in a counter-clockwise direction just beyond the first arm portion 147.

The clockwise rotation of the pulley operates to reset latching mechanism 84 and thereby reset the holding arm 86 in its disengaged position. Due to the limited relative rotation provided between the pulley 48 and the drive hub 184, the pulley 48 rotates about the drive hub 184 until the drive dog 186 is driven into the surface **190*a*. The trip arm 192 remains in the radially extended position until the cam follower end 194 engages the cam surface 202 and moves to the inner track 204. This results, therefore, in the trip end 196 engaging the first arm portion 147 in a clockwise direction, causing the tripping lever 136 to rotate in a counter-clockwise direction about the shaft 138. The interconnection between the tripping lever 136 and the hub 82 through rod 154 is such that the counter-clockwise rotation of the tripping lever 136 drives the hub 82 to rotate in a clockwise rotation. The latch lever 134 rides along the outer surface 127 of the hub 82 until the hub 82 has rotated the control shaft 80 back to the angular position "A" wherein the catch flange engages the notch 126. This clockwise rotation of the control shaft 80 disengages the holding arm 86 from the stop opening 87**.

Disengagement of the holding arm 86 from the stop opening 87 may be sensed by sensing hub rotation with the hub switch 234, as shown in step 264. In step 266, if the hub switch 234 does not sense the hub rotation, indicating a failure mode, the machine is deenergized. However, if as expected, the hub switch 234 senses hub rotation to angular position "A" the wash cycle continues, as shown in step 268.

In this fashion, the latching mechanism is reset by clockwise rotation of the pulley 48 while the trip arm 192 remains in the radially extending position. However, as described above, after a limited relative rotation between the pulley 48 and hub 184, the trip arm 192 returns to its disengaged position such that successive relative rotation of the trip end 196 past the tripping lever 136 does not result in contact between the trip end 196 and the first arm position 147.

It can be seen therefore, that the present invention provides a top loading automatic washer having improved basket access. This is accomplished by providing an access opening 22 extending partially down the front surface **12*a* of the enclosure 12 and a top member 14 which is configured to funnel the clothes items into the open basket 28**. Further, the present invention provides door flaps configured to not interfere with access into the basket and to be moved from an open position to a closed position by a single handed operation.

Although the present invention has been described with reference to specific embodiments, those of skill in the Art will recognize that changes may be made thereto without departing from the scope and spirit of the invention as set forth in the appended claims. Although a specific embodiment of our invention may be for use in a refrigerator, it may be easily understood that this invention may be applied in appliances other than refrigerators.

We claim:

1. An automatic washer, comprising:

a tub having in interior, and an opening for accessing said interior of said tub;

a cylindrical basket rotatably mounted within said tub for rotation about a horizontal axis, said basket further having an interior, and a door for accessing said interior of said basket;

an enclosure surrounding said tub having a front surface, opposing side surfaces and a top surface wherein said horizontal axis of said basket extends between said opposing side surfaces, said enclosure further having an access opening extending partially along said front surface and said top surface wherein said access opening further includes a front edge disposed on said front surface of said enclosure and a rear edge disposed on said too surface, said front edge being positioned at a lower height than said rear edge such that said access opening extends along said too surface and partially down said front surface; and a lid connected to said enclosure for selectively closing and opening said access opening, said lid extending along said top surface and partially down said front surface in the closed position;

further wherein said washer has a predetermined overall depth and a predetermined overall length of said access opening, and the ratio of said predetermined overall depth and said predetermined overall length of said access opening is less than 1.5.

2. An automatic washer according to claim 1, further wherein:

said washer has a predetermined overall height and a predetermined distance from the bottom of said enclosure to said front edge;

and the ratio of said predetermined overall height to said predetermined distance from the bottom of said enclosure to said front edge is greater than 1.1.

3. An automatic washer according to claim 1, wherein said enclosure further comprises:

a cabinet having a front panel, a back panel, opposing side panels, and an interior;

a top member interconnected with and disposed above said cabinet for defining said top surface of said enclosure, said top member having a front portion wherein said front panel and said front portion define said front surface of said enclosure, said top member further including said access opening for accessing said interior of said enclosure, said access opening having a front edge disposed on said front surface of said enclosure and a rear edge disposed on said top surface, said front edge being positioned at a lower height than said rear edge such that said access opening extends along said top surface and partially down said front surface.

4. An automatic washer according to claim 3, further wherein:

said access opening further comprises opposed first and second side edges; and said top member includes first and second downwardly sloped side interior walls disposed along said first and second side edges, respectively, of said access opening and each extending from said top surface to one of said side edges of said access opening for providing a funneling effect to direct clothes into said basket.

5. An automatic washer comprising:

a tub having an interior, and an opening for accessing said interior of said tub;

a cylindrical basket rotatably mounted within said tub for rotation about a horizontal axis, said basket further having an interior, a door for accessing said interior of said basket, and a basket opening having opposite front and rear edges;

said door of said basket being provided for selectively closing and opening said basket opening and further comprising:

a first door flap hingedly mounted on said rear edge of said basket opening and having an arc length substantially equal to the arc length of said basket opening, and with a front edge portion opposite said hinged connection with said rear edge of said basket opening;

a second door flap hingedly mounted opposite said first door flap on said front edge of said basket opening and having an arc length substantially less than said first door flap, and with a front edge portion opposite said hinged connection with said front edge of said basket opening;

wherein said first door flap is positioned adjacent said rear edge of said access opening in its open position and said second door flap is positioned adjacent said front edge of said access opening in its open position;

and wherein said second door flap is positioned in its open position at a predetermined angle such that said front edge portion of said second door flap projects into the arc traced by said front edge portion of said first door flap when said first door flap moves from an open position to a closed position such that said first and second door flaps may be moved from an open position to a closed position by downwardly urging said first door flap;

an enclosure surrounding said tub having a front surface, opposing side surfaces and a too surface wherein said horizontal axis of said basket extends between said opposing side surfaces, said enclosure further having an access opening extending partially along said front surface and said too surface wherein said access opening further includes a front edge disposed on said front surface of said enclosure and a rear edge disposed on said too surface, said front edge being positioned at a lower height than said rear edge such that said access opening extends along said too surface and partially down said front surface; and a lid connected to said enclosure for selectively closing and opening said access opening, said lid extending along said top surface and partially down said front surface in the closed position.

6. An automatic washer comprising:

a tub having an interior, and an opening for accessing said interior of said tub;

a cylindrical basket rotatably mounted within said tub for rotation about a horizontal axis, said basket further having an interior, a door for accessing said interior of said basket, and a basket opening having opposite front and rear edges;

said door of said basket being provided for selectively closing and opening said basket opening and further comprising:

a first door flap hingedly mounted on said rear edge of said basket opening and having an arc length substantially equal to the arc length of said basket opening;

a second door flap hingedly mounted opposite said first door flap on said front edge of said basket opening and having an arc length substantially less than said first door flap, wherein said second door flap includes a front edge portion opposite said hinged connection with said front edge of said basket, said door flap further comprising:

a center hook member extending from said front edge portion and having a center point;

two side hook members disposed on opposite sides of said center hook portion along said front edge portion, said side hook members having a s-curve shape wherein the top edges of said side hook members are bent forward; and said center hook and said side hook members being tapered from said center point of said center hook member;

wherein said first door flap is positioned adjacent said rear edge of said access opening in its open position and said second door flap is positioned adjacent said front edge of said access opening in its open position;

an enclosure surrounding said tub having a front surface, opposing side surfaces and a too surface wherein said horizontal axis of said basket extends between said opposing side surfaces, said enclosure further having an access opening extending partially along said front surface and said top surface wherein said access opening further includes a front edge disposed on said front surface of said enclosure and a rear edge disposed on said top surface, said front edge being positioned at a lower height than said rear edge such that said access opening extends along said top surface and partially down said front surface; and a lid connected to said enclosure for selectively closing and opening said access opening, said lid extending along said top surface and partially down said front surface in the closed position.

7. An automatic washer, comprising:

an enclosure including:

a cabinet having a front panel, a back panel, and opposing side panels, a top member interconnected with and disposed above said cabinet defining a top surface of said enclosure, said top member further having a downwardly extending front portion, said front panel and said downwardly extending front portion defining a front surface of said enclosure, said top member further including an access opening for accessing the interior of said enclosure, said access opening having a front edge disposed on said front surface of said enclosure and a rear edge disposed on said top surface, said front edge being positioned at a lower height than said rear edge such that said access opening extends along said top surface and partially down said front surface;

a lid hingedly connected to said top member for selectively closing and opening said access opening, said lid extending along said top surface and partially down said front surface in the closed position;

a tub disposed within said enclosure, said tub having an interior, and an opening for accessing said interior of said tub; and a basket rotatably mounted within said tub for rotation about a horizontal axis, said basket further having an interior, and a door for accessing said interior of said basket;

wherein said access opening of said enclosure and said opening of said tub are configured to provide angled access for loading and unloading clothes within said basket; and further wherein said washer has a predetermined overall depth and a predetermined overall length of said access opening, and the ratio of said predetermined overall depth and said predetermined overall length of said access opening is less than 1.5.

8. An automatic washer according to claim 7, further wherein:

said washer has a predetermined overall height and a predetermined distance from the bottom of said enclosure to said front edge;

and the ratio of said predetermined overall height to said predetermined distance from the bottom of said enclosure to said front edge is greater than 1.1.

9. An automatic washer according to claim 7, further wherein:

said top member includes a first and second downwardly sloped side interior wall disposed along opposite side edges of said access opening and extending from the said top surface to the side edges of said access opening for providing a funnelling effect to direct clothes into said basket.

10. An automatic washer comprising:

an enclosure including:

a cabinet having a front panel, a back panel, and opposing side panels, a top member interconnected with and disposed above said cabinet defining a top surface of said enclosure, said top member further having a downwardly extending front portion, said front panel and said downwardly extending front portion defining a front surface of said enclosure, said top member further including an access opening for accessing the interior of said enclosure, said access opening having a front edge disposed on said front surface of said enclosure and a rear edge disposed on said top top surface, said front edge being positioned at a lower height than said rear edge such that said access opening extends along said top surface and partially down said front surface;

a lid hingedly connected to said top member for selectively closing and opening said access opening, said lid extending along said top surface and partially down said front surface in the closed position;

a tub disposed within said enclosure, said tub having an interior, and an opening for accessing said interior of said tub; and a basket rotatably mounted within said tub for rotation about a horizontal axis, said basket further having an interior, and a door for accessing said interior of said basket, and a basket opening having opposite front and rear edges, said door of said basket being provided for selectively closing and opening said basket opening and further comprising:

a first door flap hingedly mounted on said rear edge of said basket opening and having an arc length substantially equal to the arc length of said basket opening;

a second door flap hingedly mounted opposite said first door flap on said front edge of said basket opening and having an arc length less than ⅓ the arc length of said first door flap;

wherein said first door flap is positioned adjacent said rear edge of said access opening in its open position and said second door flap is positioned adjacent said front edge of said access opening in its open position such that both said first and second door flaps are positioned out of the path of loading and unloading clothes items into said wash basket; and said first door flap includes a front edge portion opposite said hinged connection with said rear edge of said basket opening;

said second door flap includes a front edge portion opposite said hinged connection with said front edge of said basket opening;

said second door flap is positioned in its open position at a predetermined angle such that said front edge portion of said second door flap projects into the arc traced by said front edge portion of said first door flap when said first door flap moves from an open position to a closed position such that said first and second door flaps may be moved from an open position to a closed position by downwardly urging said first door flap; and wherein said access opening of said enclosure and said opening of said tub are configured to provide angled access for loading and unloading clothes within said basket.

11. An automatic washer comprising:

an enclosure including:

a cabinet having a front panel, a back panel, and opposing side panels, a top member interconnected with and disposed above said cabinet defining a too surface of said enclosure, said top member further having a downwardly extending front portion, said front panel and said downwardly extending front portion defining a front surface of said enclosure, said top member further including an access opening for accessing the interior of said enclosure, said access opening having a front edge disposed on said front surface of said enclosure and a rear edge disposed on said top top surface, said front edge being positioned at a lower height than said rear edge such that said access opening extends along said top surface and partially down said front surface;

a lid hingedly connected to said top member for selectively closing and opening said access opening, said lid extending along said top surface and partially down said front surface in the closed position;

a tub disposed within said enclosure, said tub having an open interior, and an opening for accessing said interior of said tub; and a basket rotatably mounted within said tub for rotation about a horizontal axis, said basket further having an open interior, a door for accessing said interior of said basket, and a basket opening having opposite front and rear edges, said door of said basket being provided for selectively closing and opening said basket opening and further comprising:

a first door flap hingedly mounted on said rear edge of said basket opening and having an arc length substantially equal to the arc length of said basket opening;

a second door flap hingedly mounted opposite said first door flap on said front edge of said basket opening and having an arc length less than ⅓ the arc length of said first door flap;

wherein said first door flap is positioned adjacent said rear edge of said access opening in its open position and said second door flap is positioned adjacent said front edge of said access opening in its open position such that both said first and second door flaps are positioned out of the path of loading and unloading clothes items into said wash basket; and said second door flap includes a front edge portion opposite said hinged connection with said front edge of said basket, said door flap further comprising:

a center hook member extending from said front edge portion and having a center point;

two side hook members disposed on opposite sides of said center hook portion along said front edge portion, said side hook members having a s-curve shape wherein the top edges of said side hook members are bent forward; and said center hook and said side hook members being tapered from said center point of said center hook member; and wherein said access opening, of said enclosure and said opening of said tub are configured to provide angled access for loading and unloading clothes within said basket.

12. An automatic washer, comprising:

an enclosure having an interior, and an access opening for accessing said interior of said enclosure;

a tub having an interior, and a tub opening generally aligned with said access opening for accessing said interior of said tub;

a lid connected to said enclosure for selectively closing and opening said access opening; and a cylindrical basket rotatably mounted within said tub for rotation about a horizontal axis, said basket having a basket opening having opposite front and rear edges and further having:

a first door flap hingedly mounted on said rear edge of said basket opening and having an arc length substantially equal to the arc length of said basket opening;

a second door flap hingedly mounted opposite said first door flap on said front edge of said basket opening and having an arc length less than ⅓ the arc length of said first door flap; and wherein said washer has a predetermined overall depth and a predetermined overall length of said access opening and the ratio of said predetermined overall depth and said predetermined overall length of said access opening is less than 1.5.

13. An automatic washer according to claim 12, further wherein:

said enclosure includes a front surface, opposing side surfaces and a top surface;

said access opening extends partially along said front surface and said top surface, said access opening further includes a front edge disposed on said front surface of said enclosure and a rear edge disposed on said top surface; and said lid extends along said top surface and partially down said front surface in the closed position;

wherein said first door flap is positioned in its open position adjacent said lid in its open position and said second door flap is positioned adjacent said front edge of said access opening in its open position such that both said first and second door flaps are positioned out of the path of loading and unloading clothes items into said wash basket.

14. An automatic washer according to claim 12, further wherein:

said washer has a predetermined overall height and a predetermined distance from the bottom of said enclosure to said front edge;

and the ratio of said predetermined overall height to said predetermined distance from the bottom of said enclosure to said front edge is greater than 1.1.

15. An automatic washer comprising:

an enclosure having an interior, and an access opening for accessing said interior of said enclosure;

a tub having an interior, and a tub opening generally aligned with said access opening for accessing said interior of said tub;

a lid connected to said enclosure for selectively closing and opening said access opening; and a cylindrical basket rotatably mounted within said tub for rotation about a horizontal axis, said basket having a basket opening having opposite front and rear edges and further having:

a first door flap hingedly mounted on said rear edge of said basket opening and having an arc length substantially equal to the arc length of said basket opening;

a second door flap hingedly mounted opposite said first door flap on said front edge of said basket opening and having an arc length less than $\frac{1}{3}$ the arc length of said first door flap; and said first door flap includes a front edge portion opposite said hinged connection with said rear edge of said basket opening;

said second door flap includes a front edge portion opposite said hinged connection with said front edge of said basket opening;

said second door flap is positioned in its open position at a predetermined angle such that said front edge portion of said second door flap projects into the arc traced by said front edge portion of said first door flap when said first door flap moves from an open position to a closed position such that said first and second door flaps may be moved from an open position to a closed position by downwardly urging said first door flap.

* * * * *